US008905495B2

(12) United States Patent
Garnett et al.

(10) Patent No.: US 8,905,495 B2
(45) Date of Patent: Dec. 9, 2014

(54) SILVERWARE BASKET FOR A DISHWASHER APPLIANCE

(75) Inventors: William Nathan Garnett, Ekron, KY (US); Anjuli B. Calvert, Louisville, KY (US)

(73) Assignee: General Electric Company, Schenectady, NY (US)

( * ) Notice: Subject to any disclaimer, the term of this patent is extended or adjusted under 35 U.S.C. 154(b) by 245 days.

(21) Appl. No.: 13/444,902

(22) Filed: Apr. 12, 2012

(65) Prior Publication Data

US 2013/0270982 A1 Oct. 17, 2013

(51) Int. Cl.
*A47B 77/08* (2006.01)
*A47B 81/00* (2006.01)

(52) U.S. Cl.
USPC ..... 312/228.1

(58) Field of Classification Search
CPC ..... A47L 15/502
USPC ..... 312/228, 228.1
See application file for complete search history.

(56) References Cited

U.S. PATENT DOCUMENTS

| | | | | |
|---|---|---|---|---|
| 4,834,125 | A * | 5/1989 | Insalaco | 134/201 |
| D391,696 | S | 3/1998 | Bournay, Jr. et al. | |
| 5,881,906 | A * | 3/1999 | Rogers et al. | 220/607 |
| D502,295 | S | 2/2005 | Feddema | |
| 2006/0237053 | A1 * | 10/2006 | Bengston et al. | 134/58 D |
| 2009/0071514 | A1 * | 3/2009 | Roth | 134/56 D |
| 2010/0101611 | A1 * | 4/2010 | Chen et al. | 134/25.2 |

* cited by examiner

*Primary Examiner* — Darnell Jayne
*Assistant Examiner* — Timothy M Ayres
(74) *Attorney, Agent, or Firm* — Dority and Manning, P.A.

(57) ABSTRACT

A dishwasher appliance is provided with a silverware basket. The silverware basket has features for creating an offset between a door of the appliance or a wall of the appliance and the silverware basket. The offset can permit debris and/or washing fluid to flow between the silverware basket and the door or the wall of the appliance.

18 Claims, 6 Drawing Sheets

SILVERWARE BASKET FOR A DISHWASHER APPLIANCE

FIELD OF THE INVENTION

The present subject matter relates generally to silverware baskets for dishwasher appliances.

BACKGROUND OF THE INVENTION

Dishwasher appliances generally include a cabinet with a wash tub therein. The wash tub defines a wash chamber. A rack assembly can be slidably received within the wash chamber and configured for receipt of articles (e.g., plates, cups, and/or bowls) for washing. A spray arm assembly configured for applying wash fluid to the articles in the rack assembly can also be mounted within the wash chamber.

Certain dishwasher appliances also include a silverware basket configured for receipt of articles (e.g., forks, knives, spoons, and/or other utensils) for washing. The silverware basket can be mounted within the wash chamber in various configurations. For example, the silverware basket can be mounted within the rack assembly, on a front of the rack assembly, and/or on a door of the appliance.

Mounting the silverware basket on a front of the rack assembly can give a consumer an impression that the rack assembly has a greater capacity compared to mounting the silverware basket within the rack assembly. However, when the silverware basket is mounted on the front of the rack assembly, the door of the appliance can impact the silverware basket when the door is moved to a closed configuration. More particularly, the door can remain in contact with the silverware basket when the door is in the closed configuration and the dishwasher appliance is in operation.

When the silverware basket is in contact with the door during operation of the dishwasher appliance, food, dirt, and/or other debris can become lodged between the door and the silverware basket. In a similar manner, such debris can become lodged between the silverware basket and other walls of the dishwasher appliance when the silverware basket is mounted within the wash chamber in another configuration. Also, when the silverware basket is in contact with the door during operation of the dishwasher appliance, washing fluid may be impeded from reaching areas below the silverware basket.

To avoid such debris collection, silverware baskets can incorporate a bumper that creates a standoff between the silverware basket and the door or wall of the cabinet. The standoff can allow washing fluid and debris to flow past the silverware basket along the door or wall of the cabinet. However, such standoffs can be visually unappealing to consumers. For example, a bumper projecting from the silverware basket can be visually intrusive and unattractive.

Accordingly, a silverware basket for a dishwasher appliance with features for creating standoff between the silverware basket and a door or wall of the appliance that can be aesthetically pleasing to consumers would be useful.

BRIEF DESCRIPTION OF THE INVENTION

A dishwasher appliance is provided with a silverware basket. The silverware basket has features for creating an offset between a door of the appliance or a wall of the appliance and the silverware basket. The offset can permit debris and/or washing fluid to flow between the silverware basket and the door or the wall of the appliance. Aspects and advantages of the invention will be set forth in part in the following description, or may be obvious from the description, or may be learned through practice of the invention.

In a first exemplary embodiment, a dishwasher appliance is provided. The dishwasher appliance includes a cabinet having a wash chamber for the receipt of articles for cleaning. The cabinet defines an opening for accessing the wash chamber. A door is rotatably mounted to the cabinet adjacent the opening of the cabinet. The door is configured for permitting selective access to the wash chamber of the cabinet through the opening. A rack assembly is slidably mounted within the wash chamber and configured for receipt of the articles for cleaning. A spray arm assembly configured for applying a fluid to the articles in the rack assembly. A silverware basket is removably mounted to a front of the rack assembly such that the silverware basket is disposed between the door and the rack assembly. The silverware basket extends between a first side and a second side along a horizontal direction. The silverware basket includes a bottom wall and a back wall that extends from the bottom wall. The back wall is positioned adjacent the rack assembly. A front wall extends from the bottom wall and is spaced apart from the back wall. The front wall is positioned adjacent the door. The bottom wall, the back wall, and the front wall define a cavity for receipt of articles for cleaning. The front wall is arcuate along the horizontal direction from about the first end to about the second end of the silverware basket such that the first and second ends of the silverware basket are spaced apart from the door.

In a second exemplary embodiment, a silverware basket for a dishwasher appliance is provided. The silverware basket extends between a first side and a second side along a horizontal direction. The silverware basket also extending between a front and a back along a transverse direction. The silverware basket includes a bottom wall and a back wall extending from the bottom wall. A front wall also extends from the bottom wall and is spaced apart from the back wall along the transverse direction. The bottom wall, the back wall, and the front wall define a cavity for receipt of articles for cleaning. The front wall is arcuate along the horizontal direction from about the first end to about the second end of the silverware basket such that a contact point of the front wall is positioned apart from the first and second ends of the silverware basket along the transverse direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
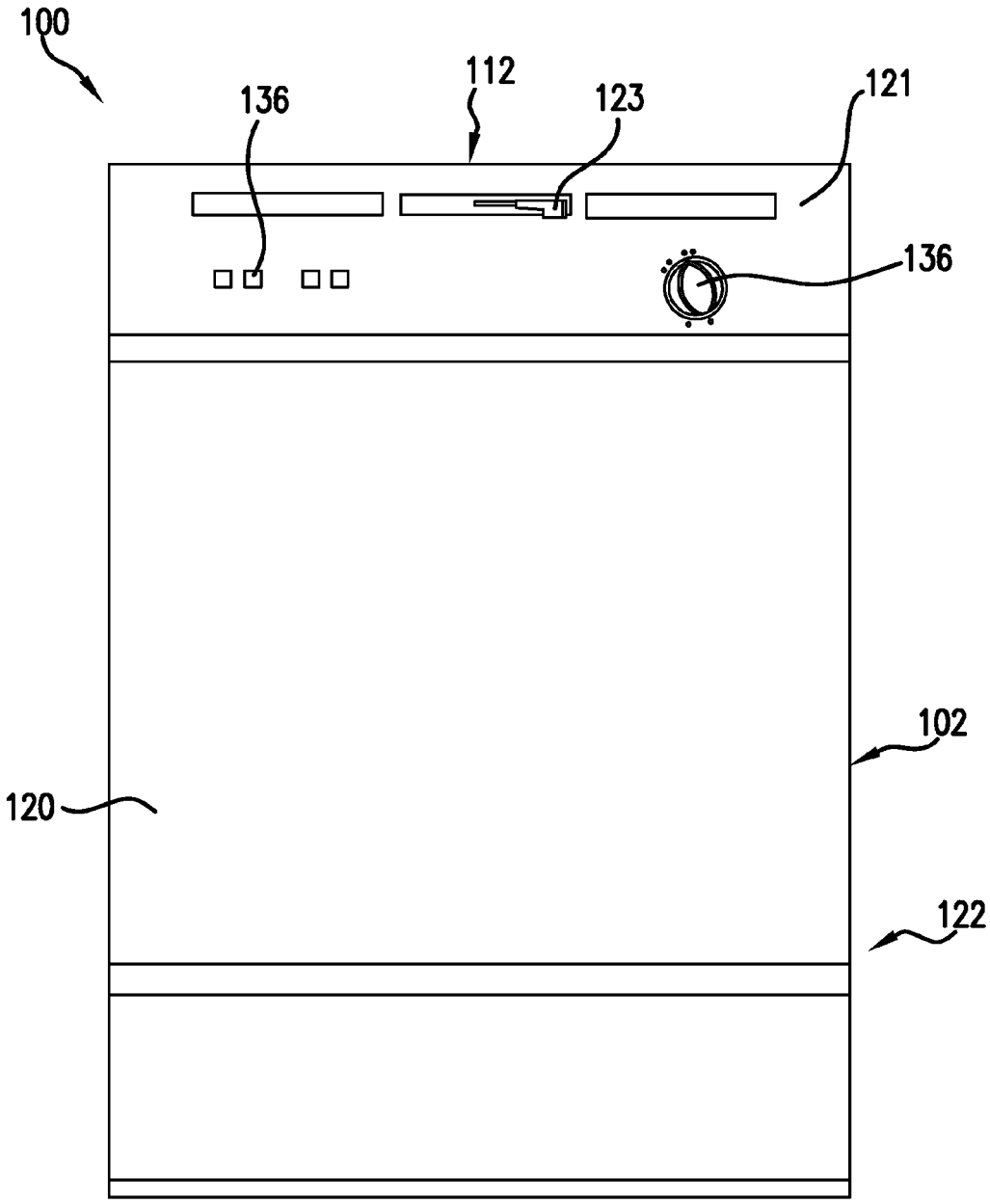
FIG. 1 provides a front view of a dishwasher appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
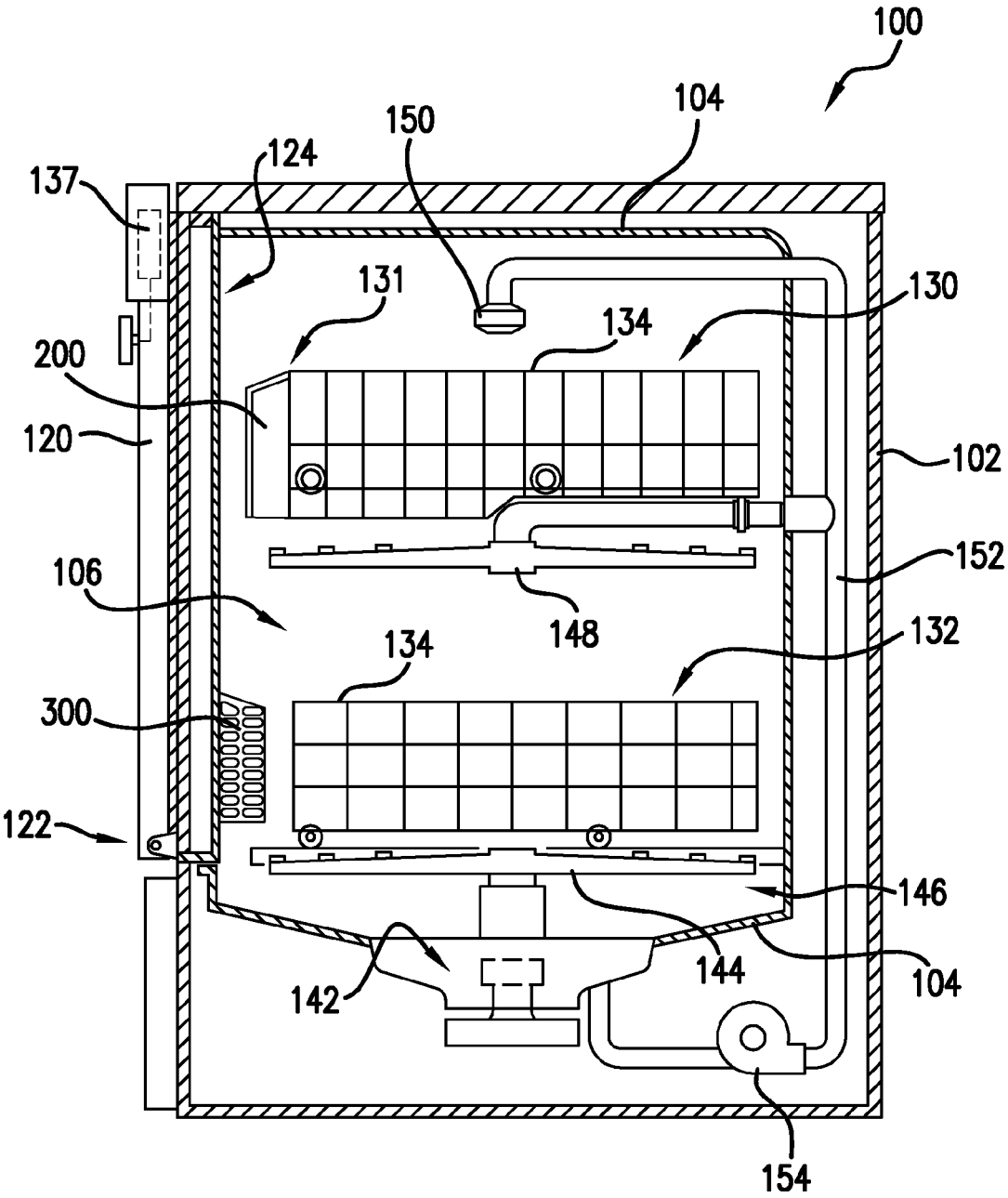
FIG. 2 provides a side, cross-sectional view of the dishwasher appliance of FIG. 1, particularly illustrating a wash chamber defined by a cabinet of the dishwasher appliance.

FIGS. 1 and 2 depict an exemplary dishwasher appliance 100 that may be configured in accordance with aspects of the present disclosure. For the particular embodiment of FIG. 1, dishwasher 100 includes a cabinet 102 with a tub 104 mounted therein that defines a wash chamber 106. Tub 104 includes a front opening (not shown) and a door 120 hinged at its bottom 122 for movement between a normally closed, vertical position (shown in FIGS. 1 and 2), wherein wash chamber 106 is sealed shut for washing operation, and a horizontal, open position for loading and unloading of articles from dishwasher 100. Latch 123 is used to lock and unlock door 120 for access to chamber 106.

Rack assemblies 130 and 132 are slidably mounted within wash chamber 106. Each of the rack assemblies 130, 132 is fabricated into lattice structures including a plurality of elongated members 134. Each rack 130, 132 is adapted for movement between an extended loading position (not shown) in which rack is substantially positioned outside wash chamber 106, and a retracted position (shown in FIGS. 1 and 2) in which the rack is located inside wash chamber 106.

A first silverware basket 200 is removably attached to rack assembly 130 adjacent a front 131 of rack assembly 130. A second silverware basket 300 is removably attached to door 120 adjacent bottom 122 of door 120. First and second silverware baskets 200, 300 are configured for receipt of silverware, forks, knives, spoons, utensils, and the like, that are otherwise too small to be securely accommodated by racks 130, 132.

With door 120 in the closed configuration (shown in FIG. 2), an interior surface 124 of door 120 may impact and be positioned adjacent first silverware basket 200 on rack assembly 130. Second silverware basket 300 is positioned adjacent door 120. First and second silverware baskets 200, 300 are discussed in greater detail below.

Dishwasher 100 further includes a lower spray-arm assembly 144 that is rotatably mounted within a lower region 146 of wash chamber 106 and above a tub sump portion 142 so as to rotate in relatively close proximity to rack assembly 132. A mid-level spray-arm assembly 148 is located in an upper region of wash chamber 106 and may be located in close proximity to upper rack 130. Additionally, an upper spray assembly 150 may be located above upper rack 130.

Lower and mid-level spray-arm assemblies 144, 148 and upper spray assembly 150 are fed by a fluid circulation assembly 152 for circulating water and dishwasher fluid in tub 104. Fluid circulation assembly 152 may include a pump 154 located in a machinery compartment 140 located below bottom sump portion 142 of tub 104, as generally recognized in the art. Each spray-arm assembly 144, 148 includes an arrangement of discharge ports or orifices for directing washing liquid onto dishes or other articles located in rack assemblies 130 and 132 and first and second silverware baskets 200 and 300. The arrangement of the discharge ports in spray-arm assemblies 144, 148 provides a rotational force by virtue of washing fluid flowing through the discharge ports. The resultant rotation of lower spray-arm assembly 144 provides coverage of dishes and other dishwasher contents with a washing spray.

Dishwasher 100 is further equipped with a controller 137 to regulate operation of dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 137 may be positioned in a variety of locations throughout dishwasher 100. In the illustrated embodiment, controller 137 may be located within a control panel area 121 of door 120 as shown. In such an embodiment, input/output ("I/O") signals may be routed between the control system and various operational components of dishwasher 100 along wiring harnesses that may be routed through bottom 122 of door 120. Typically, controller 137 includes a user interface panel 136 through which a user may select various operational features and modes and monitor progress of dishwasher 100. In one embodiment, user interface 136 may represent a general purpose I/O ("GPIO") device or functional block. In one embodiment, user interface 136 may include input components, such as one or more of a variety of electrical, mechanical or electro-mechanical input devices including rotary dials, push buttons, and touch pads. User interface 136 may include a display component, such as a digital or analog display device designed to provide operational feedback to a user. User interface 136 may be in communication with controller 137 via one or more signal lines or shared communication busses.

It should be appreciated that the present subject matter is not limited to any particular style, model, or configuration of dishwasher, and that the embodiment depicted in FIGS. 1 and 2 is for illustrative purposes only. For example, instead of racks 130, 132 depicted in FIG. 1, dishwasher 100 may be of a known configuration that utilizes drawers that pull out from cabinet 102 and are accessible from the top for loading and unloading of articles. Also, dishwasher 100 may not include an external cabinet and may, instead, include a wash chamber or tub mounted to a chassis that is not provided with external cabinetry other than door. Other configurations may be used as well.

Figure 3:
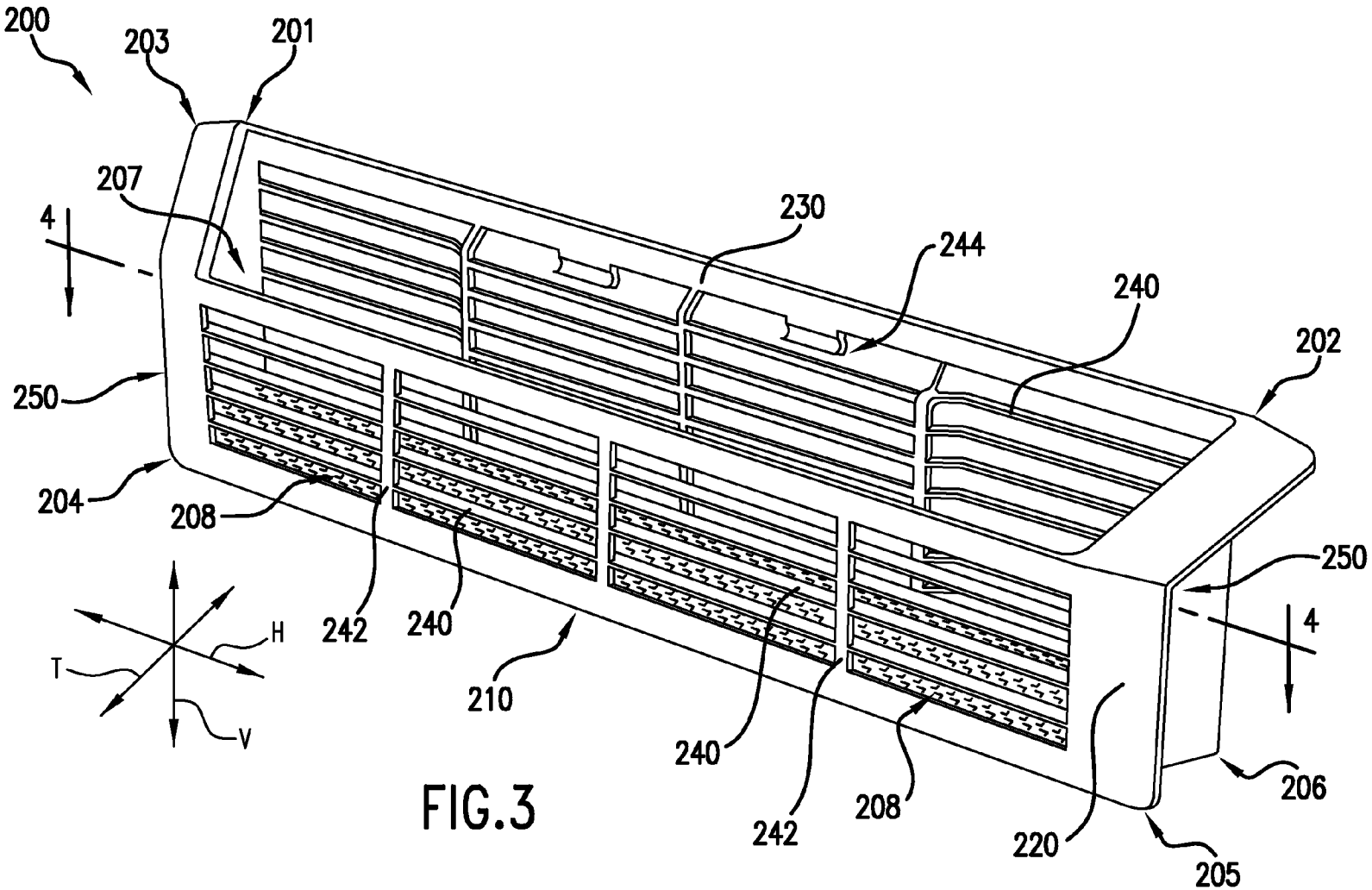
FIG. 3 illustrates a perspective view of an exemplary silverware basket according to an exemplary embodiment of the present subject matter.
Figure 4:
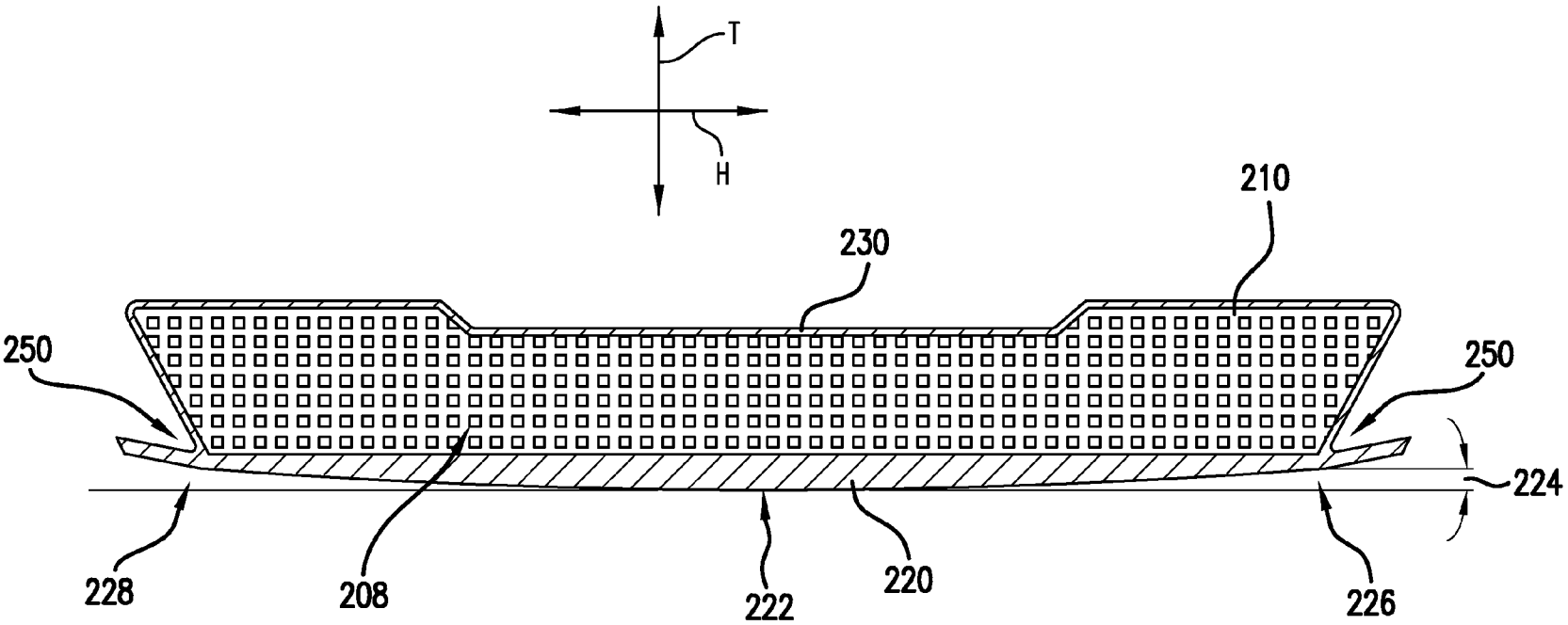
FIG. 4 provides a top, cross-sectional view of the silverware basket of FIG. 3 taken along the 4-4 axis and particularly illustrates a front panel of the silverware basket.
Figure 5:
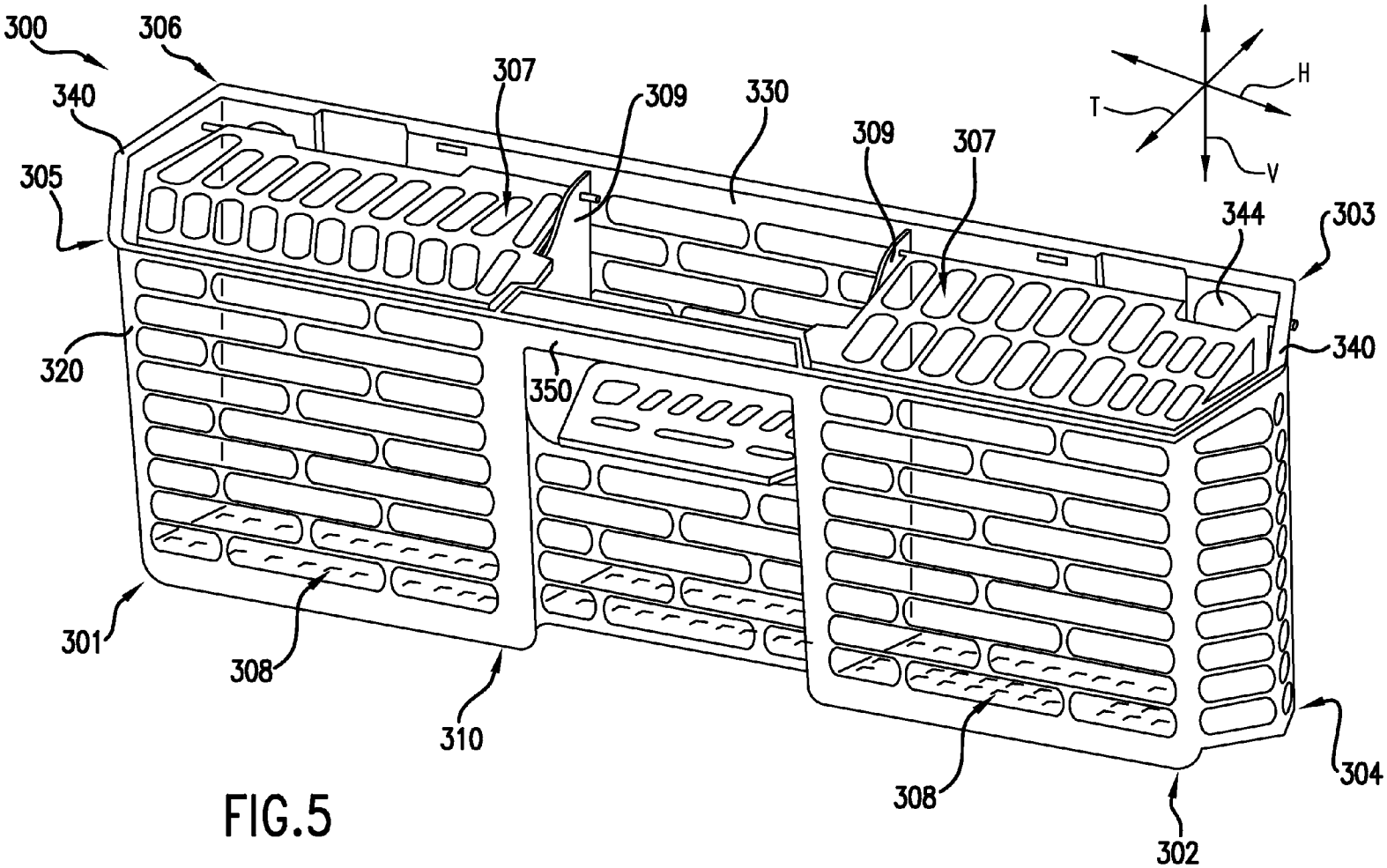
FIG. 5 illustrates a perspective view of an exemplary silverware basket according to an additional exemplary embodiment of the present subject matter.
Figure 6:
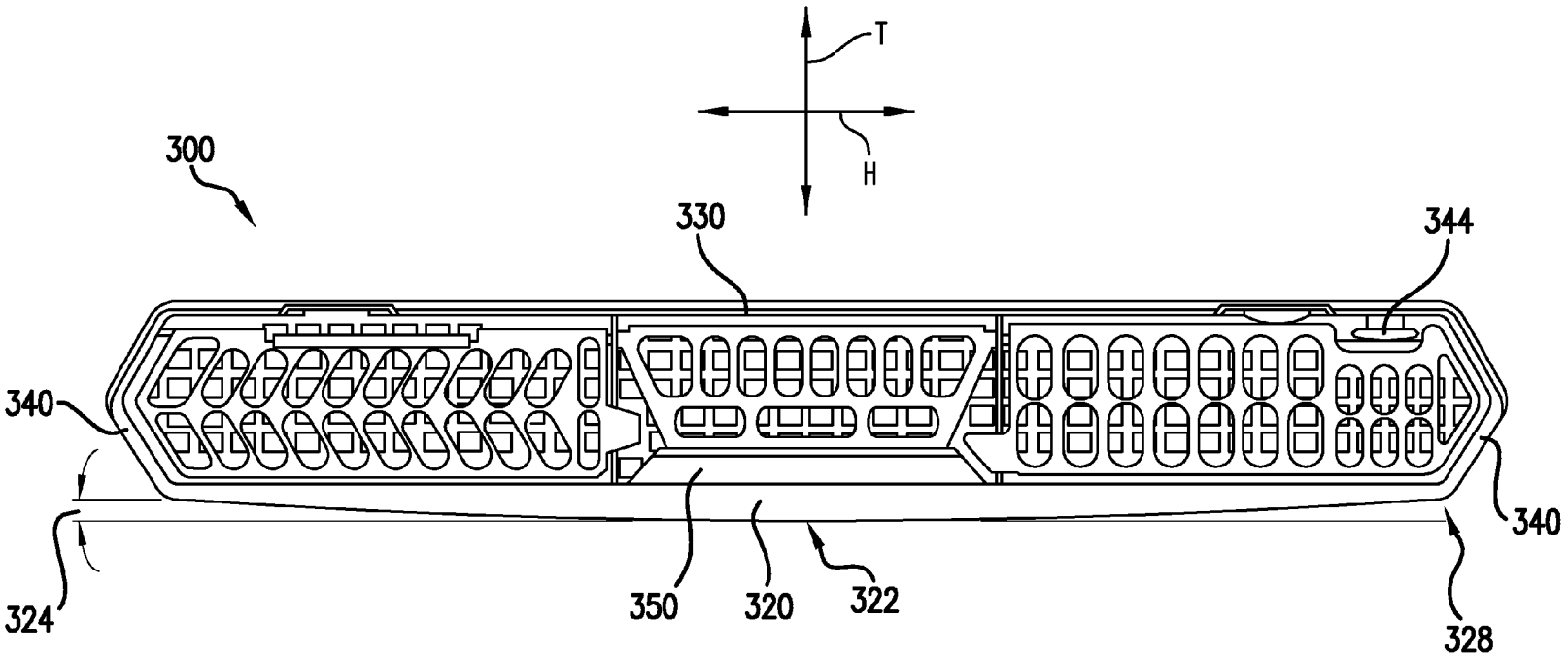
FIG. 6 provides a top view of the silverware basket of FIG. 5 and particularly illustrates a lip of the silverware basket.

FIGS. 3-4 illustrate a first silverware basket 200 according to an exemplary embodiment of the present subject matter. FIGS. 5-6 illustrate a second silver ware basket 300 according to an additional exemplary embodiment of the present subject matter. It should be understood that the present subject matter is not limited to any particular style of silverware basket and that the exemplary embodiments depicted in FIGS. 3-6 are for illustrative purposes only. Other configurations may be used as well.

First and second silverware baskets 200 and 300 perform substantially identical functions. First and second silverware baskets 200 and 300 can be selectively mounted to door 120 (FIG. 2) or rack assembly 130 (FIG. 3). Thus, dishwasher appliance 100 shown in FIG. 2 can, e.g., include silverware baskets configured like first silverware basket 200, second silverware basket 300, or both. Accordingly, FIGS. 3-6 illustrate exemplary silverware baskets that may be used in any suitable dishwasher appliance and in any suitable combination.

FIG. 3 illustrates a perspective view of first silverware basket 200. First silverware basket 200 extends between a first side 201 and a second side 202 along a horizontal direction H. First silverware basket 200 also extends between a front 205 and a back 206 along a transverse direction T. First silverware basket 200 further extends between a top 203 and a bottom 204 along a vertical direction V. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

First silverware basket 200 includes a bottom wall 210. A front wall 220 extends from bottom wall 210 along the vertical direction V. Similarly, a back wall 230 extends from bottom wall 210 along the vertical direction V. Back wall 230 and front wall 220 are spaced apart along the transverse direction T. Bottom wall 210, front wall 220, and back wall 230 define a cavity 207 for receipt of articles (e.g., forks, knives, spoons, and/or other utensils) for cleaning.

Bottom wall 210, front wall 220, and back wall 230 also define a plurality of holes 208. Plurality of holes 208 are configured for directing wash fluid into and out of cavity 207, e.g., during operation of dishwasher appliance 100. Plurality of holes 208 are also configured for directing a flow of air through cavity 207, e.g., to assist in drying articles therein. To define holes, front wall 220 and back wall 230 include a plurality of slats 240. On front wall 220, the plurality of slats 240 extend longitudinally along the horizontal direction H and are spaced apart along the vertical direction V by studs 242.

Handles 250 are mounted on first silverware basket 200 at first and second side 201 and 202 respectively. A user can lift on handles 250 to remove first silverware basket 200 from door 120 (FIG. 2) or rack assembly 130 (FIG. 2). For example, when the user lifts on handles 250, a mounting assembly 244 may disengage from door 120 or rack assembly 130. Mounting assembly 244 is configured for selectively securing first silverware basket 200 to door 120 or rack assembly 130.

FIG. 4 illustrates a top, cross-sectional view of first silverware basket 200 taken along the 4-4 axis of FIG. 3. As may be seen in FIG. 4, front wall 220 of first silverware basket 200 is arcuate along the horizontal direction H. In particular, slats 240 of front wall 220 are arcuate along the horizontal direction H. In FIGS. 3 and 4, each slat is arcuate along the horizontal direction H. However, in alternative embodiments, any suitable number of slats (e.g., one, two, or more) may be arcuate along the horizontal direction H. In addition, it should be understood that, e.g., back wall 230 may be arcuate along the horizontal direction H if back wall 230 contacts tub 104 (FIG. 2). Other configurations are available as well.

Due to the arcuate shape of front wall 220, front wall 220 includes a contact point 222. Contact point 222 is positioned further from back wall 230 along the transverse direction T than other portions of front wall 220. For example, contact point 222 is positioned further from back wall 230 along transverse direction T than a first end 226 or a second end 228 of front wall 220. Accordingly, front wall 220 defines a standoff 224 between contact point 222 and first and second ends 226 and 228 of front wall 220.

Standoff 224 may be selected such that standoff 224 is difficult for a user to observe visually. Standoff 224 may be, e.g., about seven hundredths of an inch. In alternative embodiments, standoff 224 may be any suitable measurement, e.g., between about three hundredths of an inch and about eleven hundredths of an inch, between about five hundredths of an inch and about nine hundredths of an inch, between about one hundredth of an inch and about thirteen hundredths of an inch, or between about seven hundredths of an inch and about a quarter of an inch. Standoff 224 is configured for permitting a flow of wash fluid and/or air between front wall 220 and door 120 (FIG. 2).

For example, contact point 222 may be positioned adjacent door 120 when first silverware basket 200 is mounted to rack assembly 130 (FIG. 2). In particular, contact point 222 may be the only portion of first silverware basket 200 in contact with door 120 when first silverware basket 200 is mounted to rack assembly 130 (FIG. 2) and door 128 is in the closed configuration. In such a position, without standoff 224, debris, dirt, or other particles could become lodged between front wall 220 and door 120 during operation of dishwasher appliance 100. Thus, by permitting wash fluid and/or air to flow between front wall 220 and door 120, standoff 224 can reduce the amount of debris captured by the first silverware basket 200.

As may be seen in FIGS. 3-4, front wall 220 of first silverware basket 200 is arcuate along the horizontal direction H from first end 226 to second end 228 of first silverware basket 200. Thus, a consumer may be unable to visually perceive contact point 222 and standoff 224. Accordingly, contact point 222 and standoff 224 may function to prevent debris build up while maintaining an aesthetically pleasing appearance for first silverware basket 200.

In FIG. 4, contact point 222 is disposed about equidistant from both first end 226 and second end 228. Thus, contact point 222 is about in a middle of front wall 220. However, in alternative embodiments, contact point 222 may be at any suitable location between first and second ends 226, 228.

FIG. 5 illustrates a perspective view of second silver ware basket 300. As discussed above second silverware basket 300 is substantially similar to first silverware basket 200. Thus, second silverware basket 300 extends between a first side 301 and a second side 302 along the horizontal direction H. Second silverware basket 300 also extends between a front 305 and a back 306 along the transverse direction T. Second silverware basket 300 further extends between a top 303 and a bottom 304 along the vertical direction V.

Second silverware basket 300 includes a bottom wall 310. A front wall 320 extends from bottom wall 310 along the vertical direction V. Similarly, a back wall 330 extends from bottom wall 310 along the vertical direction V. Back wall 330 and front wall 320 are spaced apart along the transverse direction T. Dividers 309 extend between front wall 320 and back wall 330 along the transverse direction T. Bottom wall 310, front wall 320, back wall 330, and dividers 309 define a plurality of cavities 307 for receipt of articles (e.g., forks, knives, spoons, and/or other utensils) for cleaning.

Bottom wall 310, front wall 320, and back wall 330 also define a plurality of holes 308. Plurality of holes 308 are configured for directing wash fluid into and out of cavities 307, e.g., during operation of dishwasher appliance 100. Plurality of holes 308 are also configured for directing a flow of air through cavities 307, e.g., to assist in drying articles therein.

A handle 350 is mounted to second silverware basket 300. A user can lift on handle 350 to remove second silverware basket 300 from door 120 (FIG. 2) or rack assembly 130 (FIG. 2). For example, when the user lifts on handle 350, a mounting assembly 344 may disengage from door 120 or rack assembly 130. Mounting assembly 344 is configured for selectively securing second silverware basket 300 to door 120 or rack assembly 130.

A lip 340 is positioned adjacent top 303 of second silverware basket 300. Lip 340 extends away from the walls of silverware basket 300. For example, lip 340 extends from both front and back walls 320 and 330 along the transverse direction T. Lip 340 is discussed in greater detail below.

FIG. 6 illustrates a top view of second silverware basket 300. As may be seen in FIG. 6, front wall 320 of second silverware basket 300 is arcuate along the horizontal direction H. In particular, lip 340 adjacent front wall 320 is arcuate along the horizontal direction H. However, it should be understood that in other exemplary embodiments of the present invention, e.g., back wall 330 or lip 340 adjacent back wall 330 may be arcuate along the horizontal direction H. Other configurations are available as well.

Due to the arcuate shape of lip 340 adjacent front wall 320, lip 340 includes a contact point 322. Contact point 322 is positioned further from back wall 330 along the transverse direction T than other portions of lip 340. For example, contact point 322 is positioned further from back wall 330 along transverse direction T than a first end 326 or a second end 328 of lip 340. Accordingly, lip 340 defines a standoff 322 between contact point 322 and first and second ends 326 and 328 of lip 340. Standoff 322 of second silverware basket 300 is substantially similar to standoff 224 of first silverware basket 200. Thus, standoff 322 is configured for permitting a flow of wash fluid and/or air between front wall 320 and door 120 (FIG. 2).

In alternative embodiments, front wall 220 or lip 340 may have any suitable shape. For example, while in FIGS. 3-4, front wall 220 is convex along horizontal direction H and, in FIGS. 5-6, lip 340 is convex along horizontal direction H, front wall 220 or lip 340 may be concave so as to define two contact points at ends 326 and 328. Thus, front wall 220 and lip 340 may have any other suitable shape or profile for permitting a flow of wash fluid and/or air between front wall 320, 420 and door 120 (FIG. 2).

In addition, it should be understood that interior surface 124 of door 120 may be arcuate along the horizontal direction H. Thus, e.g., contact points 222 and 322 can impact door 120 at a peak of door 120 along the horizontal direction H such that standoffs 224 and 324 between front walls 220 and 320 and door 120 may be further increased along the transverse direction T.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance comprising:

a tub defining a wash chamber;

a door mounted to said tub, said door configured for permitting selective access to the wash chamber of said tub;

a rack assembly selectively positioned within the wash chamber of said tub and configured for the receipt of articles for washing;

a silverware basket removably mounted to a front of said rack assembly such that said silverware basket is disposed between said door and said rack assembly when said door is in a closed position, said silverware basket extending between a first side and a second side along a horizontal direction, wherein said silverware basket comprises:

a bottom wall;

a back wall extending from said bottom wall, said back wall positioned adjacent said rack assembly;

a front wall extending from said bottom wall and spaced apart from said back wall, said front wall positioned adjacent said door when said door is in the closed position;

a pair of sidewalls extending between said back wall and said front wall, each side wall of said pair of sidewalls positioned at a respective one of the first and second sides of said silverware basket;

wherein said bottom wall, said back wall, said pair of sidewalls, and said front wall define a cavity for receipt of articles for cleaning, wherein said front wall is arcuate along the horizontal direction between the sidewalls of said pair of sidewalls such that a contact point of said front wall is positioned on said door and said front wall is spaced apart from said door at the first and second ends of said silverware basket by between three hundredths of an inch and one quarter of an inch when said door is in the closed position.

2. The dishwasher appliance of claim 1, wherein said front wall comprises a plurality of slats extending along the horizontal direction from about the first end to about the second end of said silverware basket, wherein said plurality of slats is substantially arcuate along the horizontal direction.

3. The dishwasher appliance of claim 1, wherein said silverware basket further comprises a divider extending between said front wall and said back wall in order to divide the cavity into a first cavity and a second cavity.

4. The dishwasher appliance of claim 1, wherein said bottom wall, said back wall, and said front wall define a plurality of holes for directing wash fluid out of the cavity.

5. The dishwasher appliance of claim 1, wherein said front wall comprises a lip extending along the horizontal direction from the first end to the second end of said silverware basket, wherein said lip is substantially arcuate along the horizontal direction.

6. The dishwasher appliance of claim 1, wherein said front wall is arcuate along the horizontal direction such that the first and second ends of said silverware basket are spaced apart from said door by between five hundredths of an inch and about nine hundredths of an inch.

7. The dishwasher appliance of claim 1, wherein said door is arcuate along the horizontal direction.

8. The dishwasher appliance of claim 7, wherein said door and said front wall are arcuate along the horizontal direction such that the first and second ends of said silverware basket are spaced apart from said door by between five hundredths of an inch and about nine hundredths of an inch.

9. The dishwasher appliance of claim 1, wherein said silverware basket is constructed of plastic.

10. A silverware basket for a dishwasher appliance, the silverware basket extending between a first side and a second side along a horizontal direction, the silverware basket also extending between a front and a back along a transverse direction, the silverware basket comprising:

a bottom wall;

a back wall extending from said bottom wall; and a front wall extending from said bottom wall and spaced apart from said back wall along the transverse direction;

a pair of sidewalls extending between said back wall and said front wall along the transverse direction, each sidewall of said pair of sidewalls positioned at a respective one of the first and second sides of the silverware basket;

wherein said bottom wall, said back wall, said pair of sidewalls, and said front wall define a cavity for receipt of articles for cleaning, wherein said front wall is arcuate along the horizontal direction between said pair of sidewalls such that a contact point of said front wall is spaced apart from the sidewalls of the pair of sidewalls at the first and second ends of said silverware basket along the transverse direction by between three hundredths of an inch and one quarter of an inch.

11. The silverware basket of claim 10, wherein said front wall is arcuate along the horizontal direction from about the first end to about the second end of said silverware basket such that the contact point of said front wall is positioned further from said back wall along the transverse direction than the first and second ends of said silverware basket.

12. The silverware basket of claim 10, wherein said front wall comprises a plurality of slats extending along the horizontal direction from about the first end to about the second end of said silverware basket, wherein said plurality of slats are substantially arcuate along the horizontal direction.

13. The silverware basket of claim 10, further comprising a divider extending between said front wall and said back wall in order to divide the cavity into a first cavity and a second cavity.

14. The silverware basket of claim 10, wherein said bottom wall, said back wall, and said front wall define a plurality of holes for directing wash fluid out of the cavity.

15. The silverware basket of claim 10, wherein said front wall comprises a lip extending along the horizontal direction from the first end to the second end of said silverware basket, wherein said lip is substantially arcuate along the horizontal direction.

16. The silverware basket of claim 10, wherein said front wall is arcuate along the horizontal direction such that the contact point of said front wall and the first and second ends of said silverware basket are spaced apart along the transverse direction by between five hundredths of an inch and about nine hundredths of an inch.

17. The silverware basket of claim 10, wherein said back wall includes an attachment mechanism for selectively attaching the silverware basket to a rack of the dishwasher appliance.

18. The silverware basket of claim 17, wherein said attachment mechanism is configured for hanging the silverware basket from a front of the rack.

* * * * *